United States Patent [19]

Arakawa et al.

[11] Patent Number: 4,950,559

[45] Date of Patent: Aug. 21, 1990

[54] RADIATION IMAGE STORAGE PANEL

[75] Inventors: Satoshi Arakawa; Junji Miyahara; Kenji Takahashi, all of Kaisei, Japan

[73] Assignee: Fuji Photo Film Co., Ltd., Kaisei, Japan

[21] Appl. No.: 333,723

[22] Filed: Apr. 4, 1989

Related U.S. Application Data

[63] Continuation of Ser. No. 194,051, Jun. 30, 1987, abandoned, which is a continuation of Ser. No. 802,629, Nov. 29, 1985, abandoned, which is a continuation of Ser. No. 586,708, Mar. 6, 1984, abandoned.

[30] Foreign Application Priority Data

Mar. 7, 1983 [JP] Japan ..... 58-37836

[51] Int. Cl.[5] ..... H05B 33/00

[52] U.S. Cl. ..... 428/690; 250/484.1; 428/691

[58] Field of Search ..... 428/690, 691; 250/484.1, 486.1

[56] References Cited

U.S. PATENT DOCUMENTS

| | | | |
|---|---|---|---|
| 3,107,178 | 10/1963 | Rindome | 428/690 X |
| 3,294,569 | 12/1966 | Messineo et al. | 428/690 X |
| 4,054,799 | 10/1977 | Wolfe et al. | 428/691 X |
| 4,336,154 | 6/1982 | Nishimura et al. | 250/327.2 X |
| 4,350,893 | 9/1982 | Takahashi et al. | 250/327.2 X |
| 4,380,702 | 4/1983 | Takahashi et al. | 250/484.1 X |
| 4,394,581 | 7/1983 | Takahashi et al. | 250/486.1 X |
| 4,415,471 | 11/1983 | Degenhardt | 428/691 X |

*Primary Examiner*—James Seidleck

*Attorney, Agent, or Firm*—Sixbey, Friedman, Leedom & Ferguson

[57] ABSTRACT

A radiation image storage panel comprising a support and a phosphor layer provided thereon which comprises a binder and a stimulable phosphor dispersed therein, characterized in that a light-reflecting layer containing a white pigment is provided between the support and the phosphor layer and that said light-reflecting layer is colored with a colorant capable of absorbing a portion of stimulating rays for the stimulable phosphor.

7 Claims, 2 Drawing Sheets

RADIATION IMAGE STORAGE PANEL

This application is a continuation of Ser. No. 194,051, filed June 30, 1987, which was a continuation of Ser. No. 802,629 filed Nov. 29, 1985; which was a continuation of Ser. No. 586,708 filed Mar. 6, 1984, which are all now abandoned.

BACKGROUND OF THE INVENTION

1. Field of the Invention

This invention relates to a radiation image storage panel and more particularly, to a radiation image storage panel comprising a support and a phosphor layer provided thereon which comprises a binder and a stimulable phosphor dispersed therein.

2. Description of Prior Arts

For obtaining a radiation image, there has been conventionally employed a radiography utilizing a combination of a radiographic film having an emulsion layer containing a photosensitive silver salt material and a radiographic intensifying screen.

As a method replacing the above-described radiography, a radiation image recording and reproducing method utilizing a stimulable phosphor as described, for instance, in U.S. Pat. No. 4,239,968, has been recently paid much attention. In the radiation image recording and reproducing method, a radiation image storage panel comprising a stimulable phosphor (i.e., stimulable phosphor sheet) is used, and the method involves steps of causing the stimulable phoshor of the panel to absorb radiation energy having passed through an object or having radiated from an object; exciting the stimulable phosphor with an electromagnetic wave such as visible light and infrared rays (hereinafter referred to as "stimulating rays") to sequentially release the radiation energy stored in the stimulable phosphor as light emission (stimulated emission); photoelectrically converting the emitted light to give electric signals; and reproducing the electric signals as a visible image on a recording material such as a photosensitive film or on a displaying device such as CRT.

In the above-described radiation image recording and reproducing method, a radiation image can be obtained with a sufficient amount of information by applying a radiation to the object at considerably smaller dose, as compared with the case of using the conventional radiography. Accordingly, this radiation image recording and reproducing method is of great value especially when the method is used for medical diagnosis.

The radiation image storage panel employed in the above-described radiation image recording and reproducing method has a basic structure comprising a support and a phosphor layer provided on one surface of the support. Further, a transparent film is generally provided on the free surface (surface not facing the support) of the phosphor layer to keep the phosphor layer from chemical deterioration or physical shock.

The phosphor layer comprises a binder and stimulable phosphor particles dispersed therein. The stimulable phosphor emits light (stimulated emission) when excited with stimulating rays after having been exposed to a radiation such as X-rays. Accordingly, the radiation having passed through an object or having radiated from an object is absorbed by the phosphor layer of the radiation image storage panel in proportion to the applied radiation dose, and a radiation image of the object is produced in the radiation image storage panel in the form of a radiation energy-stored image (latent image). The radiation energy-stored image can be released as stimulated emission (light emission) by applying stimulating rays to the panel, for instance, by scanning the panel with stimulating rays. The stimulated emission is then photoelectrically converted to electric signals, so as to produce a visible image from the radiation energy-stored image.

It is desired for the radiation image storage panel employed in the radiation image recording and reproducing method to have a high sensitivity and to provide an image of high quality (high sharpness, high graininess, etc.).

For enhancing the sensitivity of a radiation image storage panel, it has been known that a light-reflecting layer is provided between the support and the phosphor layer, for instance, by vapor-depositing a metal such as aluminum on the support, laminating a metal foil such as an aluminum foil thereon or coating it with a dispersion comprising a binder and a white pigment to form a light-reflecting layer, and subsequently forming the phosphor layer on the light-reflecting layer. A radiation image storage panel having the light-reflecting layer containing a white pigment is disclosed in Japanese Patent Provisional Publication No. 56(1981)-12600 (corresponding to U.S. Pat. No. 4,380,702).

For enhancing the sharpness of an image provided by a radiation image storage panel, it has been known to color the panel with a colorant capable of absorbing at least a portion of stimulating rays for a stimulable phosphor contained therein. A radiation image storage panel colored with such colorant is disclosed, for instance, in Japanese Patent Provisional Publication No. 55(1980)-163500 (corresponding to U.S. Pat. No. 4,394,581 and European Patent Publication No. 21174).

Further, in order to obtain a radiation image storage panel providing an image of higher sharpness than that provided by the radiation image storage panel having the light-reflecting layer containing a white pigment when the comparison is made on the same sensitivity level basis, it has been known to provide a white pigment light-reflecting layer between the support and the phosphor layer and to color the portion of the panel which is positioned on the stimulating rays-incident side with respect to the light-reflecting layer with such a colorant as mentioned above. For example, at least one of a subbing layer, a phosphor layer and a protective film is colored in the case that a panel comprises a support, a white pigment light-reflecting layer, the subbing layer, the phosphor layer and the protective film, superposed in this order. Such a radiation image storage panel is also disclosed in the above-mentioned Japanese Patent Provisional Publication No. 56(1980)-12600.

A radiation image storage panel employed in the radiation image recording and reproducing method, as described above, is desirable to have a higher sensitivity and to provide an image more improved in the quality, especially for applying the method to medical diagnosis. Accordingly, a further improvement in the sensitivity of a radiation image storage panel and the quality of the image provided thereby is desired.

SUMMARY OF THE INVENTION

It is an object of the present invention to provide a radiation image storage panel improved in not only the sensitivity thereof but also the sharpness of the image provided thereby.

The above-mentioned object can be accomplished by a radiation image storage panel comprising a support and a phosphor layer provided thereon which comprises a binder and a stimulable phosphor dispersed therein, characterized in that a light-reflecting layer containing a white pigment is provided between the support and the phosphor layer and that said light-reflecting layer is colored with a colorant capable of absorbing a portion of stimulating rays for the stimulable phosphor.

Figure 1A:
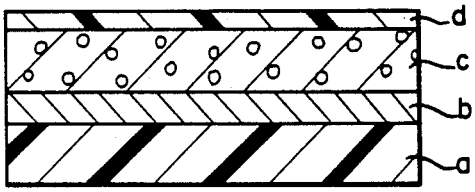
FIG. 1 diagrammatically shows a sectional view of an example of the radiation image storage panel according to the present invention (A) and sectional views of examples of the known radiation image storage panels (B, C and D).
Figure 1B:
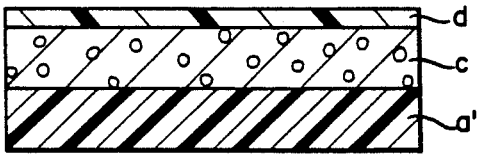
Figure 1C:
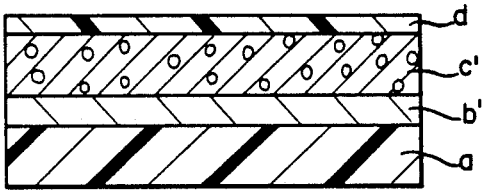
Figure 1D:
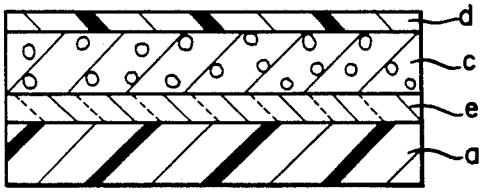
Figure 2:
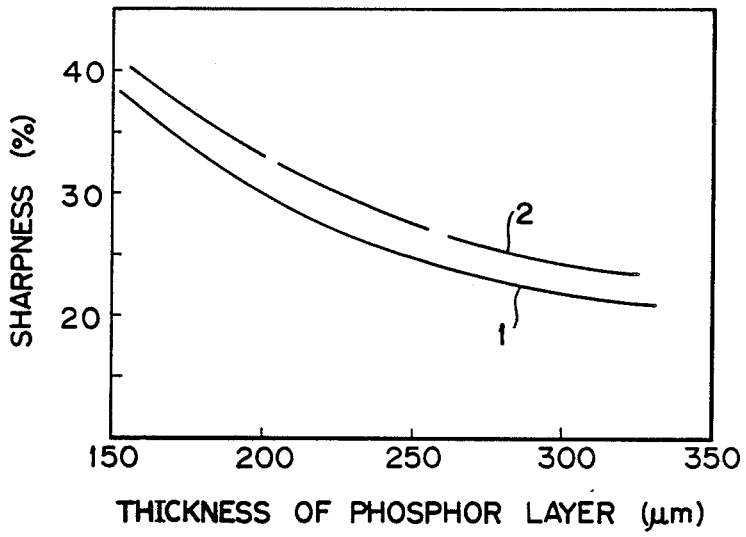

a: support, a': support containing carbon black, b: colored light-reflecting layer, b': light-reflecting layer, c: phosphor layer, c': colored phosphor layer, d: protective film, e: colored subbing layer FIG. 2 graphically illustrates a relationship between a thickness of phosphor layer and a sharpness (Curve 1) in the radiation image storage panel according to the present invention (Panel A) as well as in the known radiation image storage panels (Panels B and D), and a relationship therebetween (Curve 2) in the known radiation image storage panel (Panel C).

Figure 3:
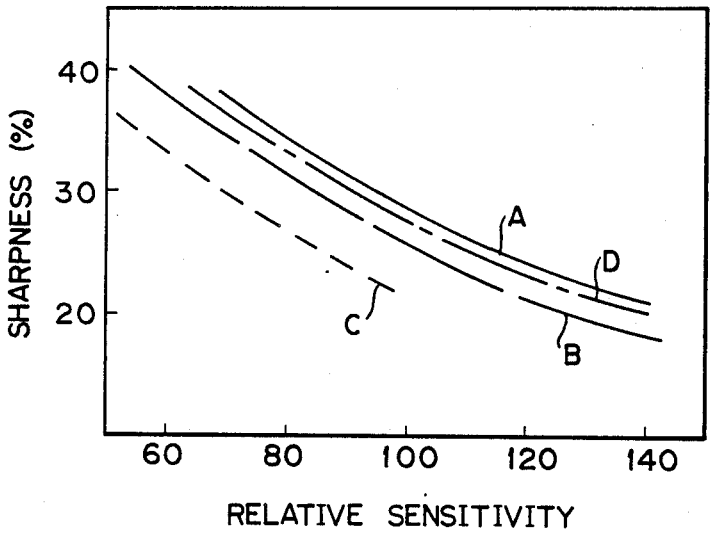

FIG. 3 graphically illustrates a relationship between a relative sensitivity and a sharpness in the radiation image storage panel according to the present invention (Curve A) and relationships therebetween in the known radiation image storage panels (Curves B, C and D).

DETAILED DESCRIPTION OF THE INVENTION

In the radiation image storage panel of the present invention, the improvement of sensitivity of the panel as well as the improvement of sharpness of the image provided thereby are accomplished by providing a white pigment light-reflecting layer colored with a colorant between the support and the phosphor layer.

When a radiation such as X-rays having passed through an object or having radiated from an object enters a phosphor layer of a radiation image storage panel, stimulable phosphor particles contained in the phosphor layer absorb the radiation energy. Thereby, the radiation image of the object is recorded on the phosphor layer as a radiation energy-stored image. Then, when an electromagnetic wave such as visible light and infrared rays (stimulating rays) impinges upon the radiation image storage panel, a phosphor particle having received the stimulating rays emits light in the near ultraviolet to visible wavelength region. Since thus emitted light does not have a directivity, it advances in all directions and a part of the light directly enters a photosensor such as a photomultiplier positioned close to the surface of the panel in which the entering light is then converted to electric signals. Thus, the radiation energy-stored image in the panel is reproduced as a visible image.

Another part of the emitted light advances toward the interface between the phosphor layer and the support (in the opposite direction of the photosensor), and the light other than that absorbed by or passing through the support is reflected by the support surface to enter the photosensor and to be converted to electric signals. That is, the light to be converted to the electric signals by the photosensor is sum of the light entering directly thereinto and the light entering thereinto after reflected by the support.

Accordingly, when the light which is emitted by the phosphor particles and advances toward the interface between the support and the phosphor layer vanishes through absorption by the support or the light scatters away by transmission through the support, the sensitivity of the radiation image storage panel decreases.

It has been proposed to provide a white pigment light-reflecting layer between the support and the phosphor layer as described hereinbefore, in order to prevent the decrease of sensitivity of the radiation image storage panel arising from the above-mentioned phenomenon. The provision of the white pigment-containing light-reflecting layer on the support enables to effectively prevent the phenomenon of vanishment of the emitted light arising from absorption by the support or from transmission through the support, while it gives the same effects to the stimulating rays. More in detail, when a part of the stimulating rays pass through the phosphor layer without exciting the phosphor particles and reach the white pigment light-reflecting layer, the stimulating rays are reflected by the light-reflecting layer to spread widely within the phosphor layer. As the result, both the phosphor particles to be excited and the phosphor particles present outside thereof are simultaneously excited, which causes the decrease of sharpness of the resulting image (which is obtained by converting the light emitted by these phosphor particles to electric signals and reproducing them).

In order to prevent the decrease of the sharpness of image, it has been also proposed to color the portion of the panel which is present on the stimulating rays-incident side with respect to the white pigment light-reflecting layer, such as the phosphor layer or protective film, with a colorant capable of selectively absorbing the stimulating rays as stated hereinbefore. However, for example, the colored phosphor layer or protective film unfavorably absorbs the stimulating rays having directly entered from the protective film and the light emitted by the stimulable phosphor, in addition to the unnecessary stimulating rays having spread widely in the phosphor layer owing to the reflecting or scattering by the light-reflecting layer. Accordingly, the sensitivity of the panel decreases.

As a result of the study, the present inventors have found that a radiation image storage panel having a white pigment light-reflecting layer colored with a colorant capable of selectively absorbing the stimulating rays is more improved in the sensitivity than the known panel being colored at the portion on the stimulating rays-incident side with respect to the light-reflecting layer, when compared on the same sharpness level basis. The colored light-reflecting layer prepared by coloring the light-reflecting layer containing a white pigment effectively reflects the light emitted by the stimulable phosphor with little absorption thereof, while effectively absorbs the unfavorable stimulating rays.

In other words, the above-mentioned effect makes it possible to reduce the thickness of phosphor layer of radiation image storage panel as compared with that of the conventional panel when the sensitivity thereof is at the same level basis, and to improve the sharpness of the image provided thereby at the same sensitivity level.

The radiation image storage panel of the present invention having the above-described advantages can be prepared, for instance, in the following manner.

The support material employed in the present invention can be selected from those employed in the conventional radiogaphic intensifying screens or those employed in the known radiation image storage panels. Examples of the support material include plastic films such as films of cellulose acetate, polyester, polyethylene terephthalate, polyamide, polyimide, triacetate and polycarbonate; metal sheets such as aluminum foil and aluminum alloy foil; ordinary papers; baryta paper; resin-coated papers; pigment papers containing titanium dioxide or the like; and papers sized with polyvinyl alcohol or the like. From the viewpoint of characteristics of a radiation image storage panel as an information recording material, a plastic film is preferably employed as the support material of the invention.

On the support, an adhesive layer may be provided by coating a polymer material such as gelatin over the surface of the support (on the light-reflecting layer side) so as to enhance the bonding between the support and the colored light-reflecting layer provided thereon.

Examples of the white pigment preferably employable in the invention include $TiO_2$ (anatase-type, rutile-type), MgO, $2PbCO_3.Pb(OH)_2$, $BaSO_4$, $Al_2O_3$, $M^{II}FX$ (in which $M^{II}$ is at least one element selected from the group of Ba, Srn ad Ca; and X is at least one element selected from the group of Cl and Br), $CaCO_3$, ZnO, $Sb_2O_3$, $SiO_2$, $ZrO_2$, $Nb_2O_5$, lithopone ($BaSO_4+ZnS$), magnesium silicate, basic lead silicosulfate, basic lead phosphate and aluminum silicate. These white pigments have a particularly high covering power and show a high refractive index, so that they can satisfactorily scatter light by reflection or refraction, and accordingly the sensitivity of the resulting radiation image storage panel is prominently improved.

In the case that the phosphor employed in the radiation image storage panel is a stimulable phosphor which emits light having a wavelength in the near ultraviolet region as well as in the visible region such as a divalent europium activated alkaline earth metal fluorohalide phosphor and a rare earth element activated rare earth oxyhalide phosphor, $M^{II}FX$ (in which $M^{II}$ has the same definition as above), anatase-type $TiO_2$, MgO, $2PbCO_3.Pb(OH)_2$, $BaSO_4$, and $Al_2O_3$ are preferred, because they show the reflection spectra in the near ultraviolet to visible wavelength region and the colored light-reflecting layer containing them can be easily provided on the support.

The colorant employable in the radiation image storage panel of the present invention is required to absorb at least a portion of the stimulating rays. The colorant preferably has the reflection characteristics that the mean reflectance thereof in the wavelength region of the stimulating rays for the stimulable phosphor employed in the panel is lower than the mean reflectance thereof in the wavelength region of the light emitted by said stimulable phosphor upon stimulation thereof. From the viewpoint of the sharpness of the image provided by the panel, it is desired that the mean reflectance of the colorant in the wavelength region of the stimulating rays is as low as possible. On the other hand, from the viewpoint of the sensitivity of the panel, it is desired that the mean reflectance of the colorant in the wavelength region of the light emitted by the stimulable phosphor is as high as possible.

Accordingly, the preferred colorant depends on the stimulable phosphor employed in the radiation image storage panel. From the viewpoint of practical use, the stimulable phosphor is desired to give stimulated emission in the wavelength region of 300–500 nm when excited with stimulating rays in the wavelength region of 400–800 nm as described below. Employable for such a stimulable phosphor is a colorant having a body color ranging from blue to green so that the mean reflectance thereof in the wavelength region of the stimulating rays for the phosphor is lower than the mean reflectance thereof in the wavelength region of the light emitted by the phosphor upon stimulation and that the difference therebetween is as large as possible.

Examples of the colorant employed in the invention include the colorants disclosed in the above-mentioned Japanese Patent Provisional Publication No. 55(1980)-163500, that is: organic colorants such as Zapon Fast Blue 3G (available from Hoechst AG), Estrol Brill Blue N-3RL (available from Sumitomo Chemical Co., Ltd.), Sumiacryl Blue F-GSL (available from Sumitomo Chemical Co., Ltd.), D & C Blue No. 1 (available from National Aniline), Spirit Blue (available from Hodogaya Chemical Co., Ltd.), Oil Blue No. 603 (available from Orient Co., Ltd.), Kiton Blue A (available from Ciba-Geigy), Aizen Cathilon Blue GLH (available from Hodogaya Chemical Co,. Ltd.), Lake Blue A.F.H. (available from Kyowa Sangyo Co., Ltd.), Rodalin Blue 6GX (available from Kyowa Sangyo Co., Ltd.), Primocyanine 6GX (available from Inahata Sangyo Co., Ltd.), Brillacid Green 6BH (available from Hodogaya Chemical Co., Ltd.), Cyanine Blue BNRS (available from Toyo Ink Mfg. Co., Ltd.), Lionol Blue SL (available from Toyo Ink Mfg. Co., Ltd.), and the like; and inorganic colorants such as ultramarine blue, cobalt blue, ceruleanbue, chromium oxide, $TiO_2$-ZnO-CoO-NiO pigment, and the like.

Examples of the colorant employable in the present invention also include the colorants described in the Japanese Patent Provisional Publication No. 57(1982)-96300 (corresponding to U.S. patent application Ser. No. 326,642), that is: organic metal complex salt colorants having Color Index Nos. 24411, 23160, 74180, 74200, 22800, 23150, 23155, 24401, 14880, 15050, 15706, 15707, 17941, 74220, 13425, 13361, 13420, 11836, 74140, 74380, 74350, 74460, and the like.

Among the above-mentioned colorants having a body color from blue to green, particularly preferred are the organic metal complex salt colorants which show no emission in the longer wavelength region than that of the stimulating rays as described in the latter Japanese Patent Provisional Publication No. 57(1982)-96300.

A colored light-reflecting layer can be formed on the support by the following procedure: The white pigment, colorant and a binder are added to an appropriate solvent and they are sufficiently mixed to prepare a homogeneous coating dispersion of the white pigment and colorant in the binder solution. The coating dispersion is uniformly applied onto the surface of the support (or the surface of the adhesive layer provided on the support) to form a coating layer, and subsequently the coating layer is heated so as to obtain a colored light-reflecting layer. The binder and solvent employable in the preparation of the colored light-reflecting layer can be selected from binders and solvents employable in the preparation of a phosphor layer as mentioned below.

The ratio between the binder and the white pigment in the coating dispersion is within the range of from 1:1 to 1:50 (binder: white pigment, by weight). From the viewpoint of the reflection characteristics of the colored light-reflecting layer, the binder is preferably employed in a small amount. Further, considering the easiness of formation of the colored light-reflecting layer, the ratio between the binder and the white pigment is preferably within the range of from 1:2 to 1:20, by weight.

The ratio between the binder and the colorant in the coating dispersion is within the range of from $10^6$:1 to $10^2$:1 (binder: colorant, by weight) in the case of a dye colorant. The ratio between the binder and the colorant is within the range of from 105:1 to 1:10, by weight in the case of a pigment colorant. The thickness of the colored light-reflecting layer preferably ranges from 5 to 100 $\mu$m.

From the viewpoint of the sensitivity of the resulting radiation image storage panel, the mean reflectance of thus formed colored light-reflecting layer in the wavelength region of the light emitted by the stimulable phosphor upon stimulation thereof is as high as possible. Generally, the mean reflectance of the colored light-reflecting layer is preferably not lower than 20% of the mean reflectance of a light-reflecting layer equivalent to said light-reflecting layer except for being uncolored with the colorant in the same wavelength region.

On the other hand, from the viewpoint of the sharpness of an image provided by the panel, the mean reflectance of the colored light-reflecting layer in the wavelength region of the stimulating rays for the stimulable phosphor is as low as possible. Generally, the mean reflectance of the colored light-reflecting layer is not higher than 95% of the mean reflectance of the uncolored light-reflecting layer equivalent to said light-reflecting layer in the same wavelength region. The term "reflectance" used herein means a reflectance measured by use of an intergrating-sphere photometer.

As described in Japanese Patent Application No. 57(1982)-82431 (corresponding to U.S. patent application Ser. No. 496,278 and European Patent Publication No. 92241), the phosphor layer-side surface of the colored light-reflecting layer may be provided with protruded and depressed portions for enhancement of the sharpness of the image.

On the colored light-reflecting layer prepared as described above, a phosphor layer are formed. The phosphor layer comprises a binder and stimulable phosphor particles dispersed therein.

The stimulable phosphor, as described hereinbefore, gives stimulated emission when excited with stimulating rays after exposure to a radiation. In the viewpoint of practical use, the stimulable phosphor is desired to give stimulated emission in the wavelength region of 300–500 nm when excited with stimulating rays in the wavelength region of 400–800 nm.

Examples of the stimulable phosphor employable in the radiation image storage panel of the present invention include:

SrS:Ce,Sm, SrS:Eu,Sm, $ThO_2$:Er, and $La_2O_2S$:Eu,Sm, as described in U.S. Pat. No. 3,859,527;

ZnS:Cu,Pb, $BaO.xAl_2O_3$:Eu, in which x is a number satisfying the condition of $0.8 \leqq x \leqq 10$, and $M^{2+}O.xSiO_2$:A, in which $M^{2+}$ is at least one divalent metal selected from the group consisting of Mg, Ca, Sr, Zn, Cd and Ba, A is at least one element selected from the group consisting of Ce, Tb, Eu, Tm, Pb, Tl, Bi and Mn, and x is a number satisfying the condition of $0.5 \leqq x \leqq 2.5$, as described in U.S. Pat. No. 4,326,078;

$(Ba_{1-x-y},Mg_xCa_y)FX:aEu^{2+}$, in which X is at least one element selected from the group consisting of Cl and Br, x and y are numbers satisfying the conditions of $0<x+y \leqq 0.6$, and $xy \neq 0$, and a is a number satisfying the condition of $10^{-6} \leqq a \leqq 5 \times 10^{-2}$, as described in Japanese Patent Provisional Publication No. 55(1980)-12143;

LnOX:xA, in which Ln is at least one element selected from the group consisting of La, Y, Gd and Lu, X is at least one element selected from the group consisting of Cl and Br, A is at least one element selected from the group consisting of Ce and Tb, and x is a number satisfying the condition of $0<x<0.1$, as described in the above-mentioned U.S. Pat. No. 4,236,078;

$(Ba_{1-x},M^{II}_x)FX:yA$, in which $M^{II}$ is at least one divalent metal selected from the group consisting of Mg, Ca, Sr, Zn and Cd, X is at least one element selected from the group consisting of Cl, Br and I, A is at least one element selected from the group consisting of Eu, Tb, Ce, Tm, Dy, Pr, Ho, Nd, Yb and Er, and x and y are numbers satisfying the conditions of $0 \leqq x \leqq 0.6$ and $0 \leqq y \leqq 0.2$, respectively, as described in Japanese Patent Provisional Publication No. 55(1980)-12145.

Among the above-described stimulable phosphors, the divalent europium activated alkaline earth metal fluorohalide phosphor and rare earth element activated rare earth oxyhalide phosphor are particularly preferred, because these show stimulated emission of high luminance. The above-described stimulable phosphors are given by no means to restrict the stimulable phosphor employable in the present invention. Any other phosphors can be also employed, provided that the phosphor gives stimulated emission when excited with stimulating rays after exposure to a radiation.

Examples of the binder to be contained in the phosphor layer include: natural polymers such as proteins (e.g. gelatin), polysaccharides (e.g. dextran) and gum arabic; and synthetic polymers such as polyvinyl butyral, polyvinyl acetate, nitrocellulose, ethylcellulose, vinylidene chloride-vinyl chloride copolymer, polymethyl methacrylate, vinyl chloride-vinyl acetate copolymer, polyurethane, cellulose acetate butyrate, polyvinyl alcohol, and linear polyester. Particularly preferred are nitrocellulose, linear polyester, and a mixture of nitrocellulose and linear polyester.

The phosphor layer can be formed on the colored light-reflecting layer, for instance, by the following procedure.

In the first place, stimulable phosphor particles and a binder are added to an appropriate solvent, and then they are mixed to prepare a coating dispersion of the phosphor particles in the binder solution.

Examples of the solvent employable in the preparation of the coating dispersion include lower alcohols such as methanol, ethanol, n-propanol and n-butanol; chlorinated hydrocarbons such as methylene chloride and ethylene chloride; ketones such as acetone, methyl ethyl ketone and methyl isobutyl ketone; esters of lower alcohols with lower aliphatic acids such as methyl acetate, ethyl acetate and butyl acetate; ethers such as dioxane, ethylene glycol monoethylether and ethylene glycol monoethyl ether; and mixtures of the above-mentioned compounds.

The ratio between the binder and the stimulable phosphor in the coating dispersion may be determined according to the characteristics of the aimed radiation image storage panel and the nature of the phosphor employed. Generally, the ratio therebetween is within the range of from 1:1 to 1:100 (binder: phosphor, by weight), preferably from 1:8 to 1:40.

The coating dispersion may contain a dispersing agent to improve the dispersibility of the phosphor particles therein, and may contain a variety of additives such as a plasticizer for increasing the bonding between the binder and the phosphor particles in the phosphor layer. Examples of the dispersing agent include phthalic acid, stearic acid, caproic acid and a hydrophobic surface active agent. Examples of the plasticizer include phosphates such as triphenyl phosphate, tricresyl phosphate and diphenyl phosphate; phthalates such as diethyl phthalate and dimethoxyethyl phthalate; glycolates such as ethylphthalyl ethyl glycolate and butylphthalyl butyl glycolate; and polyesters of polyethylene glycols with aliphatic dicarboxylic acids such as polyester of triethylene glycol with adipic acid and polyester of diethylene glycol with succinic acid.

The coating dispersion containing the phosphor particles and the binder prepared as described above is applied evenly to the surface of the colored light-reflecting layer to form a layer of the coating dispersion. The coating procedure can be carried out by a conventional method such as a method using a doctor blade, a roll coater or a knife coater.

After applying the coating dispersion to the colored light-reflecting layer, the coating dispersion is then heated slowly to dryness so as to complete the formation of a phosphor layer. The thickness of the phosphor layer varies depending upon the characteristics of the aimed radiation image storage panel, the nature of the phosphor, the ratio between the binder and the phosphor, etc. Generally, the thickness of the phosphor layer is within the range of from 20 μm to 1 mm, and preferably from 50 to 500 μm.

The phosphor layer can be provided onto the colored light-reflecting layer by the methods other than that given in the above. For instance, the phosphor layer is initially prepared on a sheet material (false support) such as a glass plate, a metal plate or a plastic sheet using the aforementioned coating dispersion and then thus prepared phosphor layer is superposed on the colored light-reflecting layer provided on the support (genuine support) by pressing or using an adhesive agent.

The radiation image storage panel generally has a transparent film on a free surface of a phosphor layer to protect the phosphor layer from physical and chemical deterioration. In the radiation image storage panel of the present invention, it is preferably to provide a transparent film for the same purpose.

The transparent film can be provided onto the phosphor layer by coating the surface of the phosphor layer with a solution of a transparent polymer such as a cellulose derivative (e.g. cellulose acetate or nitrocellulose), or a synthetic polymer (e.g. polymethyl methacrylate, polyvinyl butyral, polyvinyl formal, polycarbonate, polyvinyl acetate, or vinyl chloride-vinyl acetate copolymer), and drying the coated solution. Alternatively, the transparent film can be provided onto the phosphor layer by beforehand preparing it from a polymer such as polyethylene terephthalate, polyethylene, polyvinylidene chloride or polyamide, followed by placing and fixing it onto the phosphor layer with an appropriate adhesive agent. The transparent protective film preferably has a thickness within a range of approx. 3 to 20 μm.

The following examples further illustrate the present invention, but these examples are by no means understood to restrict the invention.

EXAMPLE 1

To a mixture of polyurethane, barium fluorobromide (BaFBr) particles and blue pigment (Ultramarine Blue No. 8800; manufactured by Daiichi Kasei Co., Ltd.) in the ratio of 1:10:1 (binder:barium fluorobromide:pigment, by weight) were added toluene and ethanol, and they were sufficiently stirred by means of homogenizer to prepare a homogeneous coating dispersion having a viscosity of 25–35 PS (at 25° C.).

Subsequently, the coating dispersion was applied to a polyethylene terephthalate sheet (support, thickness: 250 μm) placed horizontally on a glass plate. The application of the coating dispersion was carried out using a doctor blade. After the coating was complete, the support having the coating dispersion was placed in an oven and heated at a temperature gradually rising from 25° to 100° C. Thus, a colored light-reflecting layer having the thickness of approx. 20 μm was formed on the support.

To a mixture of a divalent europium activated alkaline earth metal fluorobromide ($BaFBr:Eu^{2+}$) phosphor particles and a linear polyester resin were added to methyl ethyl ketone and nitrocellulose (nitrification degree: 11.5%), to prepare a dispersion containing the phosphor particles and the binder in the ratio of 20:1 (phosphor:binder, by weight). Tricresyl phosphate, n-buthanol and methyl ethyl ketone were added to the dispersion and the mixture was sufficiently stirred by means of a propeller agitater to obtain a homogeneous coating dispersion having a viscosity of 25–35 PS (at 25° C.).

Then the coating dispersion was applied onto the colored light-reflecting layer in the same manner as described above to form a phosphor layer having the thickness of approx. 250 μm.

On the phosphor layer was placed by a polyethylene terephthalate transparent film (thickness: 12 μm, provided with a polyester adhesive layer on one surface) to combine the film and the phosphor layer with the adhesive layer. Thus, a radiation image storage panel consisting essentially of a support, a colored light-reflecting layer, a phosphor layer, and a transparent protective film was prepared.

Further, a variety of radiation image storage panels were prepared, varying the thickness of phosphor layer within the range of 100–400 μm. The prepared panels were named Panel A.

COMPARISON EXAMPLE 1

As a support, a polyethylene terephthalate sheet containing carbon black (thickness: 250 μm) was prepared.

The procedure of Example 1 was repeated except that the phosphor layer was directly provided on the so prepared support without provision of the colored light-reflecting layer, to prepare a radiation image storage panel consisting essentially of a support, a phosphor layer and a transparent protective film.

Further, a variety of radiation image storage panels were prepared, varying the thickness of phosphor layer within the range of 100–400 μm. The prepared panels were named Panel B.

COMPARISON EXAMPLE 2

The same light-reflecting layer as that of Example 1 except that the layer was not colored was formed on the support in the same manner as described in Example 1.

The coating dispersion for a phosphor layer was prepared in the same manner as described in Example 1 except that a blue pigment (Ultramarine Blue No. 8800) was contained therein in a ratio of 100:0.1 (phosphor:-pigment, by weight).

The procedure of Example 1 was repeated except for providing a phosphor layer onto the so formed light-reflecting layer, using the so prepared coating dispersion, to prepare a radiation image storage panel consisting essentially of a support, a light-reflecting layer, a colored phosphor layer and a transparent protective film.

Further, a variety of radiation image storage panels were prepared, varying the thickness of phosphor layer within the range of 100–400 μm. The prepared panels were named Panel C.

COMPARISON EXAMPLE 3

The procedure of Example 1 was repeated except that a colored subbing layer (thickness: approx. 20 μm) comprising a binder (polyurethane) and a blue pigment (Ultramarine Blue No. 8800) in a ratio of 1:1 (binder:-pigment, by weight) was provided onto the support instead of the colored light-reflecting layer, to prepare a radiation image storage panel consisting essentially of a support, a colored subbing layer, a phosphor layer and a transparent protective film.

Further, a variety of radiation image storage panels were prepared, varying the thickness of phosphor layer within the range of 100–400 μm. The prepared panels were named Panel D.

The sectional views of the radiation image storage panels (Panels A to D) prepared as described above are diagrammatically shown in FIG. 1.

In FIG. 1,

A is a sectional view of the radiation image storage panel according to the present invention (Panel A of Example 1) comprising a support (a), a colored light-reflecting layer (b), a phosphor layer (c) and a protective film (d);

B is a sectional view of the radiation image storage panel (Panel B) of Comparison Example 1) comprising a support containing carbon black (a'), a phosphor layer (c) and a protective film (d);

C is a sectional view of the radiation image storage panel (Panel C of Comparison Example 2) comprising a support (a), a light-reflecting layer (b'), a colored phosphor layer (c') and a protective film (d), which is disclosed in the aforementioned Japanese Patent Provisional Publication No. 56(1981)-12600;

D is a sectional view of the radiation image storage panel (Panel D of Comparison Example 3) comprising a support (a), a colored subbing layer (e), a phosphor layer (c) and a protective film (d), which is disclosed in the aforementioned Japanese Patent Provisional Publication No. 55(1980)-163500.

The radiation image storage panels prepared as described above were evaluated on the sharpness of the image provided thereby and the sensitivity thereof according to the following test.

(1) Sharpness of image

The radiation image storage panel was exposed to X-rays at voltage of 80 KVp through an MTF chart and subsequently scanned with a He-Ne laser beam (wavelength: 632.8 nm) to excite the phosphor particles contained in the panel. The light emitted by the phosphor layer of the panel was detected and converted to electric signals by means of a photosensor (a photomultiplier having spectral sensitivity of type S-5). The electric signals were reproduced by an image reproducing apparatus to obtain a radiation image of the MTF chart as a visible image on a displaying apparatus, and the modulation transfer function (MTF) value of the visible image was determined. The MTF value was given as a value (%) at the spacial frequency of 2 cycle/mm.

(2) Sensitivity

The radiation image storage panel was exposed to X-rays at voltage of 80 KVp and subsequently scanned with a He-Ne laser beam (wavelength: 632.8 nm) to excite the phosphor. The light emitted by the phosphor layer of the panel was detected by means of the above-mentioned photosensor to measure the sensitivity thereof.

The results of the evaluation on the radiation image storage panels are graphically shown in FIG. 2.

In FIG. 2,

Curve 1 shows a relationship between a thickness of phosphor layer and a sharpness with respect to the radiation image storage panels of Example 1, Com. Example 1 and Com. Example 3 (Panels A, B and D, respectively), Curve 2 shows a relationship between a thickness of phosphor layer and a sharpness with respect to the radiation image storage panel of Com. Example 2 (Panel C).

In FIG. 3,

Curve A shows a relationship between a relative sensitivity and a sharpness with respect to the radiation image storage panel of Example 1 (Panel A).

Curve B shows a relationship between a relative sensitivity and a sharpness with respect to the radiation image storage panel of Com. Example 1 (Panel B), Curve C shows a relationship between a relative sensitivity and a sharpness with respect to the radiation image storage panel of Com. Example 2 (Panel C), Curve D shows a relationship between a relative sensitivity and a sharpness with respect to the radiation image storage panel of Com. Example 3 (Panel D).

As is evident from the results indicated by Curve 1 shown in FIG. 2, the radiation image storage panel of the present invention having a white pigment light-reflecting layer colored with the colorant provides an image having the sharpness at the same level as that of the known radiation image storage panels.

As is evident from the results indicated by Curve A shown in FIG. 3, the radiation image storage panel of the present invention having a white pigment light-reflecting layer colored with the colorant is improved in the sharpness of the image as compared with the known radiation image storage panels (indicated by Curves B to D), when the comparison is made on the same sensitivity level basis. Further, it is evident that the radiation image storage panel of the invention are improved in the sensitivity as compared with the known radiation image storage panels when the comparison is made on the same sharpness level basis.

We claim:

1. A radiation image storage panel comprising:

a support;

a phosphor layer provided on said support, said phosphor layer comprising a binder and a stimulable phosphor dispersed therein;

a light-reflecting layer comprising a binder of material selected from natural polymers and synthetic polymers and a white pigment dispersed in said binder, said light-reflecting layer being provided between said support and said phosphor layer, said light-reflecting layer being colored with a colorant capable of absorbing a portion of stimulating rays for the stimulable phosphor.

2. The radiation image storage panel as claimed in claim 1, in which said light-reflecting layer containing a white pigment is colored with such a colorant that the mean reflectance of said colorant in the wavelength region of the stimulating rays for the stimulable phosphor is lower than the mean reflectance of said colorant in the wavelength region of the light emitted by the stimulable phosphor upon stimulation thereof.

3. The radiation image storage panel as claimed in claim 1, in which the mean reflectance of said colored light-reflecting layer in the wavelength region of the stimulating rays for the stimulable phosphor is not higher than 95% of the mean reflectance of a light-reflecting layer equivalent to said light-reflecting layer except for being uncolored with the colorant in the wavelength region of said stimulation rays.

4. The radiation image storage panel as claimed in claim 1, in which the means reflectance of said colored light-reflecting layer in the wavelength region of the light emitted by the stimulable phosphor upon stimulation thereof is not lower than 20% of the mean reflectance of a light-reflecting layer equivalent to said light-reflecting layer except for being uncolored with the colorant in the wavelength region of said light.

5. The radiation image storage panel as claimed in claim 1, 2, 3 or 4, in which the stimulable phosphor is a phosphor capable of showing stimulated emission in the wavelength region of 300–500 nm upon stimulation with stimulating rays in the wavelength region of 400–800 nm.

6. The radiation image storage panel as claimed in claim 5, in which the stimulable phosphor is a divalent europium activated alkaline earth metal fluorohalide phosphor.

7. The radiation image storage panel as claimed in claim 5, in which the stimulable phopsphor is a rare earth oxyhalide phosphor.

* * * * *